US005152159A

United States Patent [19]

Kabeya et al.

[11] Patent Number: 5,152,159

[45] Date of Patent: Oct. 6, 1992

[54] WASHING MACHINE

[75] Inventors: Katsuhei Kabeya, Komaki; Yoshio Ikeda, Kasugai, both of Japan

[73] Assignee: Kabushiki Kaisha Toshiba, Kanagawa, Japan

[21] Appl. No.: 675,578

[22] Filed: Mar. 25, 1991

[30] Foreign Application Priority Data

Mar. 30, 1990 [JP] Japan ..... 2-85712

[51] Int. Cl.[5] ..... D06F 33/02; D06F 39/08

[52] U.S. Cl. ..... 68/12.02; 68/18 D; 68/23.2; 68/208

[58] Field of Search ..... 68/12.02, 18 D, 23.2, 68/208; 210/143

[56] References Cited

U.S. PATENT DOCUMENTS 2,331,700 10/1943 Kirby ..... 68/208 X

FOREIGN PATENT DOCUMENTS 15913 6/1979 Japan ..... 68/208

194481 12/1982 Japan ..... 68/208

*Primary Examiner*—Philip R. Coe

*Attorney, Agent, or Firm*—Limbach & Limbach

[57] ABSTRACT

An automatic washing machine includes an outer tub, an inner tub rotatably mounted in the outer tub and having a plurality of dehydration perforations formed in an upper end portion, a drain hole formed in the bottom of the inner tub, a valve mechanism for opening and closing the drain hole, a stopper for stopping the inner tub at a predetermined position, and a drive section mounted in the outer tub for driving the valve mechanism so that the drain hole is opened and closed, in the condition that the inner tub is stopped at the predetermined position.

15 Claims, 14 Drawing Sheets

WASHING MACHINE

BACKGROUND OF THE INVENTION

This invention relates to a washing machine having a washing and dehydrating inner tub rotatably mounted in an outer tub, and more particularly to an improvement of construction for draining the inner tub in such a washing machine.

In automatic washing machines, conventionally, a washing and dehydrating inner tub is rotatably mounted in an outer water-receiving tub. A large number of dehydrating perforations are formed almost over a circumferential wall of the inner tub. Since water is reserved in the water-receiving tub via these perforations during washing in this construction, soap powder scum or the like adheres to the inner surface of the water-receiving tub and the outer surface of the inner tub in the course of use, which causes a problem that a space between the tubs becomes insanitary because of the soap powder scum or the like. Particularly, use of various kinds of condensed detergents has recently been increased. Since the condensed detergents have a property of easily solidifying, they promote adherence of the soap powder scum to the inner tub outer surface and the outer tub inner surface, resulting in a problem.

One solution of the above-described problem is to provide an inner tub having dehydration perforations formed only in the upper end portion thereof. In this construction, water is reserved only in the inner tub during washing and the water flowing through the dehydration perforations is received by the outer tub during dehydration to be discharged outwards. Consequently, since the wash liquid is not reserved between the inner and outer tubs, the soap powder scum or the like can be prevented from adhering to the inner tub outer surface and the outer tub inner surface together with a water-saving effect. In the above-described construction, however, in order to drain the water from the inner tub, the inner tub needs to be rotated at a high speed so that the water is centrifugally discharged through the perforations formed in the upper end portion of the tub. A considerable amount of water in the inner tub is centrifugally flown away to strike against the outer tub, which produces a loud noise. Further, foreign matter such as sand or dust cannot be discharged to be accumulated on the bottom of the inner tub though the wash water in the inner tub can be discharged in the above-described manner. Thus, the foreign matter cannot be removed in accordance with the above-described construction. Additionally, since the inner tub almost full of water needs to be rotated at a high speed, a drive source with a large capacity is necessary, which would be an important problem when the washing machines are developed to cope with increase in the capacity.

To overcome the above-described disadvantage, Japanese Published Utility Model Reg. Application No. 54-15913 discloses construction shown in FIGS. 19 and 20. Referring to FIGS. 19 and 20, an inner tub 2 is rotatably mounted in an outer tub 1 and a plurality of perforations (not shown) are formed in the upper end portion of the inner tub. Four drain holes 3 are formed in the bottom of the inner tub at equal intervals. These drain holes 3 are opened and closed by valves 4. An annular disc 5 is mounted adjacent the outer bottom of the inner tub 2 so as to be vertically moved. Four small projections 5*a* are formed on the upper face of the disc 5 so as to correspond to the respective valves 4. The valves 4 are upwardly pushed by the respective projections 5*a* when the annular disc 5 is upwardly moved, thereby opening the drain holes 3. An operating member 6 is provided through the bottom of the outer tub 1 for vertical movement. The disc 5 is upwardly pushed when the operating member 6 is upwardly moved.

In the above-described construction, when the water is drained from the inner tub 2, the operating member 6 is upwardly moved to push the disc 5 upwards, thereby actuating the valves 4 to open the drain holes. The water in the inner tub 2 is discharged through the drain holes 3 formed in the bottom thereof. Consequently, a large amount of water is not centrifugally flown away to strike against the outer tub 1 and accordingly, a loud noise is not produced. Further, since the foreign matter such as sand or dust can be discharged together with the water, the foreign matter is not accumulated on the inner tub bottom.

In accordance with the conventional construction, however, the position of the inner tub 2 at which position the inner tub being rotated is stopped is changeable or random and accordingly, that of the annular disc 5 rotated with the inner tub 2 is also changeable or random. Therefore, the disc 5 is formed into an annular shape and a number of valves, for example, four valves 4 are provided so that at least one of the valves 4 is actuated by upwardly pushing a part of the disc 5 by the operating member 6 irrespective of the stop position of the disc 5. However, since the position of a portion of the disc 5 pushed by the operating member 6 is changeable, the number of valves 4 actuated and an amount of opening of the actuated valve or valves 4 are also changeable. Consequently, the water draining performance varies and that is, a period necessary for the water draining is increased. Additionally, since the numbers of valves 4 and drain holes 3 are relatively large, problems arise that the number of portions sealed is increased and the washing machine is rendered large-scaled, which problems are disadvantageous in design and assembly of the washing machine.

SUMMARY OF THE INVENTION

Therefore, an object of the present invention is to provide a washing machine wherein the space between the inner and outer tubs can be prevented from becoming insanitary, the foreign matter can be prevented from accumulating in the inner tub and the water draining performance can be stabilized.

The present invention provides a washing machine comprising an outer tub, an inner tub rotatably mounted in the outer tub, the inner tub having a plurality of dehydration openings formed in an upper end portion thereof, one or a plurality of drain holes formed in the bottom of the inner tub, a valve mechanism provided for opening and closing the drain holes, stop means for stopping the inner tub at a predetermined position, and a drive section provided in the outer tub for driving the valve mechanism so that the drain holes are opened and closed, in the condition that the inner tub is stopped at the predetermined position.

In a preferred embodiment, the present invention provides a washing machine comprising an outer tub, an inner tub rotatably mounted in the outer tub, the inner tub having one or a plurality of dehydration outlets formed in an upper end portion thereof, a single drain hole formed in the bottom of the inner tub, a valve mechanism provided for opening and closing the drain hole, a drive section provided in the outer tub for driving the valve mechanism so that the drain hole is opened and closed, and stop means for stopping the inner tub at a predetermined position where the drain hole corresponds to the drive section, the drain hole being capable of being opened and closed by the drive section and the valve mechanism when the inner tub is stopped at the predetermined position.

Since the dehydration openings are formed only in the upper end portion of the inner tub, the water is reserved only in the inner tub during washing. Consequently, the water is not reserved between the inner and outer tubs and accordingly, the soap powder scum is prevented from adhering to the inner surface of the outer tub and the outer surface of the inner tub together with the water-saving effect. Further, the drive section is activated to actuate the valve mechanism in the water draining operation so that the drain holes is opened, whereby the water in the inner tub is discharged through the drain hole formed in the bottom of the tub. Consequently, a loud noise is not produced during the water draining operation since a large amount of water can be prevented from being flown away through the dehydration openings formed in the upper end of the inner tub to thereby strike against the outer tub. Furthermore, when the water is discharged through the drain hole formed in the inner tub bottom, the foreign matter such as sand or dust is also discharged therethrough with the water, thereby preventing the foreign matter from accumulating in the inner tub. Further, since the drive section is activated to actuate the valve mechanism in the condition that the inner tub is stopped at the predetermined position by the stop means, opening and closing operations of the valve mechanism can be reliably performed. Consequently, an amount of opening of the drain hole is fixed in performance of the water draining, which stabilizes the water draining performance. Additionally, since a large number of valves as employed in the prior art are not necessary, designing and assembly of the valve mechanism having less sealing portions can be simplified.

Preferably, when a single drain hole is formed in the bottom of the inner tub, the sealing construction can be further simplified.

It is preferable that the stop means comprise a position sensor generating a position signal when the inner tub is located at the predetermined position and the stop means stop the inner tub at the predetermined position based on the position signal generated by the position sensor. Consequently, the inner tub can be readily stopped at the predetermined position based on the position signal. In this case the position sensor may comprise a sensed section provided on a balance ring of the inner tub and a sensing section provided on a cover of the outer tub. Consequently, the washing machine can be assembled sequentially from the upper part thereof, resulting in improvement of the assembly efficiency. Furthermore, since the sensing section necessitating lead wires for producing the position signal is provided on the outer tub or at the fixed side and the sensed section necessitating no lead wire is provided at the rotating side, wiring can be simplified.

The washing machine in accordance with the present invention may further comprise an agitator rotatably mounted on the inner bottom of the inner tub. In this case the drain holes is located below the agitator. Since the drain holes is covered by the agitator, clothes or the like can be prevented from colliding with or being caught by the valve mechanism. Consequently, the valve mechanism can be prevented from being damaged.

Locking means may be provided for locking the inner tub at the predetermined position in the condition that the inner tub is stopped at the predetermined position. When the drain holes is opened and closed in the condition that the inner tub is locked at the predetermined position by the locking means, the inner tub is not moved during operation of the valve mechanism. The valve mechanism can also be prevented from being damaged. In this case the locking means may comprise an engagement portion formed in a tub shaft of the inner tub, a locking member provided on an outer fixed portion of the tub shaft for engaging the engagement portion and drive means for driving the locking member. Further, the tub shaft may have a brake drum for braking the inner tub and the engagement portion may be formed in the brake drum.

It is preferable that the valve mechanism include a valve opening and closing the drain hole from inside of the inner tub and the drive section include a push member vertically moved to push the valve so that the drain hole is opened. Since water pressure acts in the direction that the valve is closed when water is reserved in the inner tub, the water sealing property of the inner tub is improved. In this case the valve may have a packing and the valve mechanism may further comprise an urging member urging the valve in the direction that the drain hole is closed by the valve. Further, the push member may be mounted on the outer tub so as to be vertically moved and the drive section further comprise a bellows provided on the outer tub so as to cover the push member and a motor driving the push member via a cam. This construction improves water sealing property of each of the outer and inner tubs.

The valve of the valve mechanism may open and close the drain hole from inside of the inner tub and the valve mechanism may further comprise a lifting member provided in the valve so as to be extended to the upper end of the inner tub. The lifting member is lifted by the drive section so that the drain hole is opened. The drive section can be disposed on the upper portion of the outer tub in this modified form. Consequently, since the drive section is not disposed on the outer tub bottom but on the outer tub upper portion, water leakage from the outer tub can be prevented.

Furthermore, the valve of the valve mechanism may be disposed on the bottom of the outer tub so as to be vertically moved. The drain hole is closed when the valve is upwardly moved and opened when the valve is downwardly moved. In this construction the inner tub needs the drain hole and not a valve or the like. Thus, the construction of the inner tub can be simplified.

In further another modified form, the valve mechanism may include a lever member pivotally mounted on the outer bottom of the inner tub and having two ends and a valve provided on one end of the lever member for opening and closing the drain hole from outside of the inner tub. Further, the drive section may include a push member vertically moved so that the same upwardly pushes the other end of the lever member to downwardly move the valve, thereby opening the drain hole. The movement stroke of the valve or an amount of opening of the drain hole can be set with ease by adjusting the rotational angle and the length of the lever member.

In further another modified form, the inner tub is braked in the condition that the inner tub is being rotated in a high-speed mode, thereby stopping the inner tub at a position in the vicinity of and not beyond a predetermined position. Subsequently, the inner tub is rotated in a low-speed mode after stopped at the position in the vicinity of and not beyond the predetermined position. Thereafter, the inner tub being rotated is braked and stopped at the predetermined position. The inner tub can be rotated in the high-speed mode until reaching the position in the vicinity of and not beyond the predetermined position and in the low-speed mode between the predetermined position and the position in the vicinity of and not beyond the predetermined position. Consequently, the period of time necessary for stopping the inner tub can be shortened. In this case the high-speed mode may be set so as to have a rotational speed lower than the speed at which the inner tub is rotated in the dehydration operation and the low-speed mode may be set so as to have such a low speed that the inner tub can be stopped immediately when braked. The inner tub may also be braked when the same is rotated seven-eighths of one rotation from the predetermined position, so that the inner tub is stopped at the position in the vicinity of and not beyond the predetermined position.

Other objects of the present invention will become obvious upon understanding of the illustrative embodiments about to be described or will be indicated in the appended claims. Various advantages not referred to herein will occur to one skilled in the art upon employment of the invention in practice.

DESCRIPTION OF THE PREFERRED EMBODIMENTS

Figure 1:
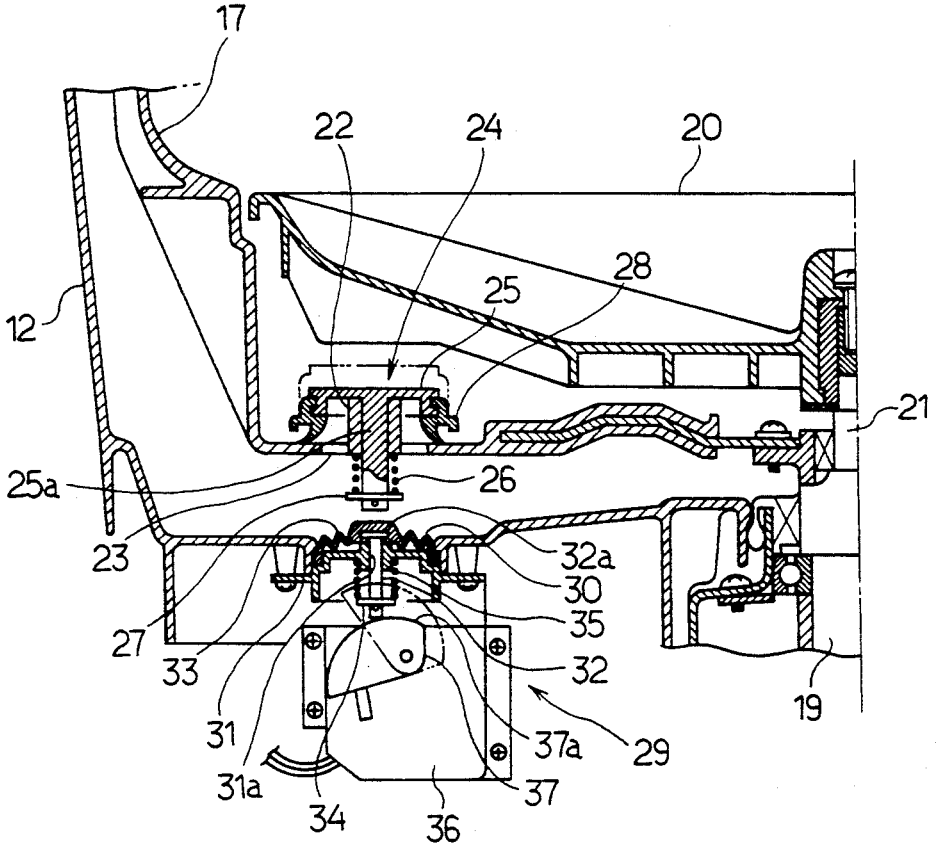
FIG. 1 is a longitudinal section of bottom portions of inner and outer tubs of a washing machine of a first embodiment in accordance with the present invention.

A first embodiment of the present invention will be described with reference to FIGS. 1 to 11 of the accompanying drawings. Referring first to FIG. 2, an outer water-receiving tub 12 is held by an elastic suspension mechanism 13 in an outer cabinet 11, a part of the elastic suspension mechanism 13 being shown. A drive mechanism 15 comprising an electric motor 14, a drain hose 16 and the like are provided below the outer tub 12. An inner rotatable tub 17 for wash and dehydration operations is rotatably mounted in the outer tub 12. A plurality of small perforations 18 serving as dehydration outlets are formed in the upper circumferential end portion of the inner tub 17 so as to be lined horizontally. The inner tub 17 is mounted to a dehydration shaft 19 projected from the drive mechanism 15 into the outer tub 12. The dehydration shaft 19 constitutes a tub shaft. An agitator 20 is rotatably mounted on a wash shaft 21 projected from the dehydration shaft 19 into the inner tub 17. The agitator 20 is rotated by the wash shaft 21 in a wash step so that the wash operation is executed.

Figure 2:
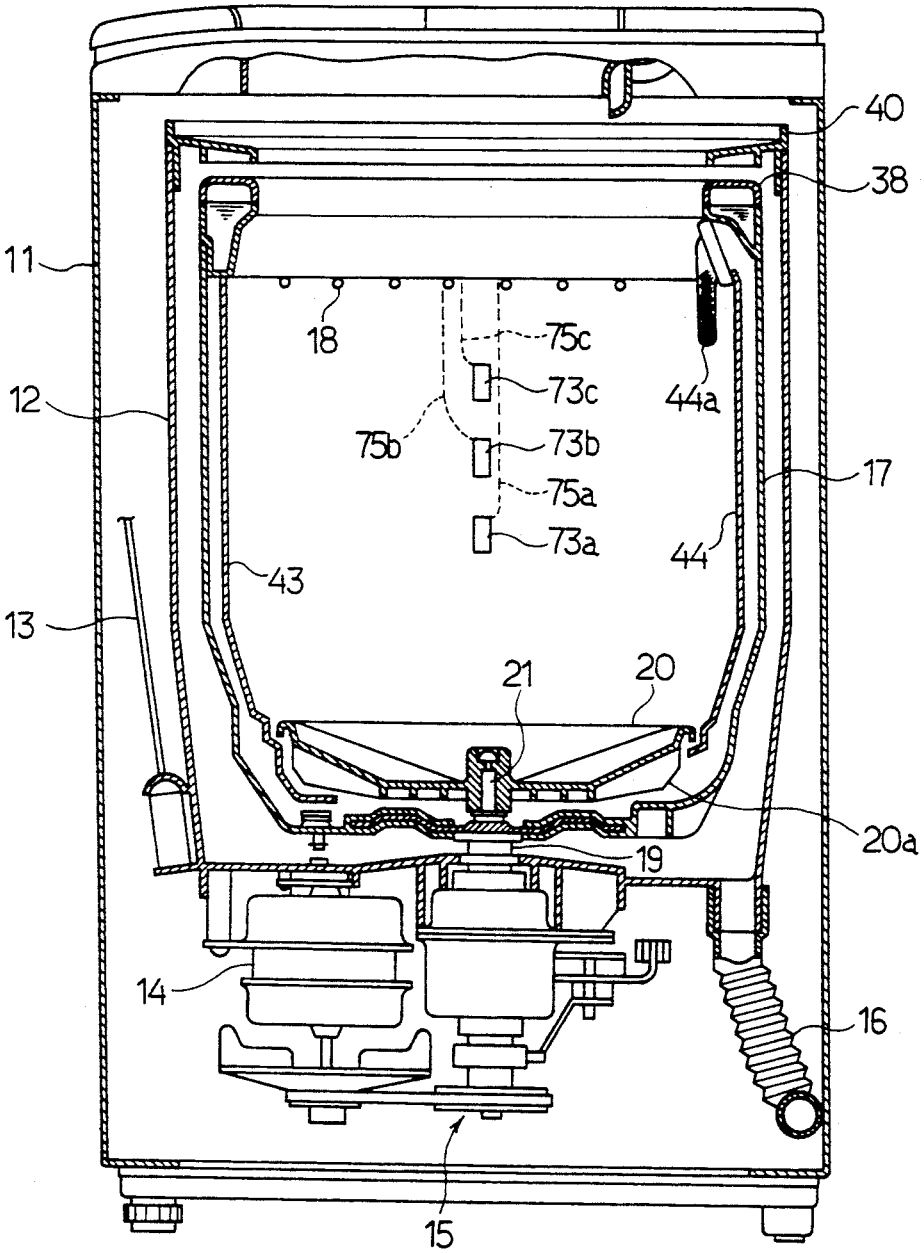
FIG. 2 is a longitudinal section of the washing machine.

Referring to FIG. 1, a cylindrical support 22 is projected from a marginal portion of the inner tub 17 bottom. A plurality of through-holes are formed around the cylindrical support 22 in the inner tub 17 bottom. These through-holes form a drain hole 23. A valve mechanism 24 for opening and closing the drain hole 23 comprises a plate valve 25, a compression coil spring 26 and a spring shoe 27. The valve 25 has a packing 28 attached to the outer periphery thereof and a bar support 25*a* downwardly projected from the underside thereof as viewed in FIG. 1. The bar support 25*a* of the valve 25 is inserted in the cylindrical support 22 of the inner tub 17 so that the valve 25 is vertically moved. The spring shoe 27 is secured to the lower end of the bar support 25*a*. The compression coil spring 26 is provided around the bar support 25*a* between the inner tub 17 bottom and the spring shoe 27. The valve 25 is usually urged by the compression coil spring 26 in the direction that the same closes the drain hole 23.

A drive section 29 for driving the above-described valve mechanism 24 is provided under the outer tub 12. A through-hole 30 is formed in the bottom of the outer tub 12 so as to correspond to the drain hole 23 of the inner tub 17. A mounting plate 31 having a central through-hole 31*a* is secured to the circumferential edge of the through-hole 30. A push rod 32 serving as a push member is inserted through the through-hole 31*a* so as to be vertically moved. A plate member 32*a* is secured to the upper end of the push rod 32. A bellows 33 is formed integrally with the plate member 32*a* so as to cover the same. The peripheral edge of the bellows 33 is water-tightly mounted on the outer bottom of the outer tub 12 by the mounting plate 31 so as to close the through-hole 30. A spring shoe 34 is secured to the lower edge of the push rod 32. A compression coil spring 35 is provided around the push rod 32 between the spring shoe 34 and the mounting plate 31. The push rod 32 is usually urged downwardly by the compression coil spring 35 so as to take a position as shown in FIG. 1. A geared motor 36 is provided below the push rod 32. The geared motor 36 has built-in gears as reduction means. A cam 37 is mounted on an output shaft of the geared motor 36. The lower end of the push rod 32 is adapted to be engaged with a cam surface 37*a* of the cam 37.

Figure 3:
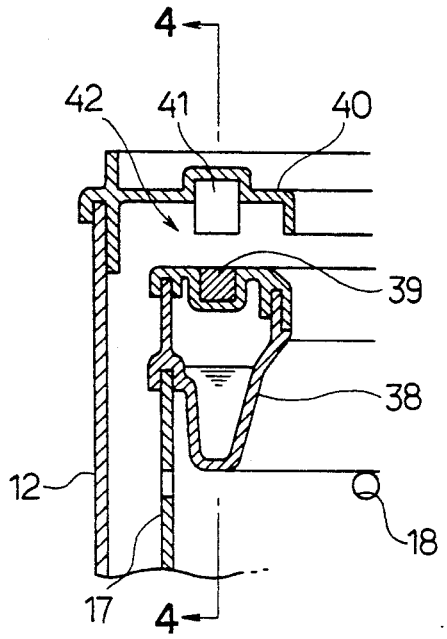
FIG. 3 is a longitudinal section of a portion of the washing machine where a position sensor is provided and its peripheral portion.
Figure 4:
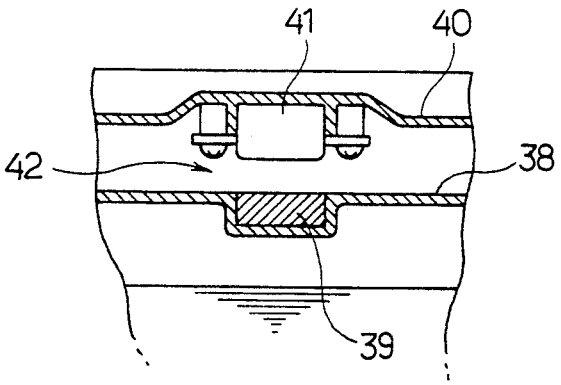
FIG. 4 is a view taken along line 4—4 in FIG. 3.

A balance ring 38 is provided around the upper end of the inner tub 17. A sensed section such as a magnet 39 is secured to the upper face of the balance ring 38, as shown in FIGS. 3 and 4. A tub cover 40 is attached to the upper end of the outer tub 12 and a sensing section such as a reed switch 41 is secured to the underside of the tub cover 40 by screws. Thus, a position sensor 42 comprises the magnet 39 and the reed switch 40. The rotational position of the inner tub 17 is sensed by the position sensor 42 at a predetermined position where the drain hole 23 and the valve mechanism 24 are opposed to the drive section 29, thereby generating a position signal. More specifically, the reed switch 41 is close to the magnet 39 in an opposite relation thereto when the inner tub 17 occupies the predetermined position, so that the reed switch 41 is turned on. Cover members 43 and 44 are provided in the inner tub 17 in a symmetrical relation so as to be each extended from the bottom to the upper end thereof. Groove-like spaces are formed between each of the cover members 43, 44 and the inner tub 17.

Figure 5:
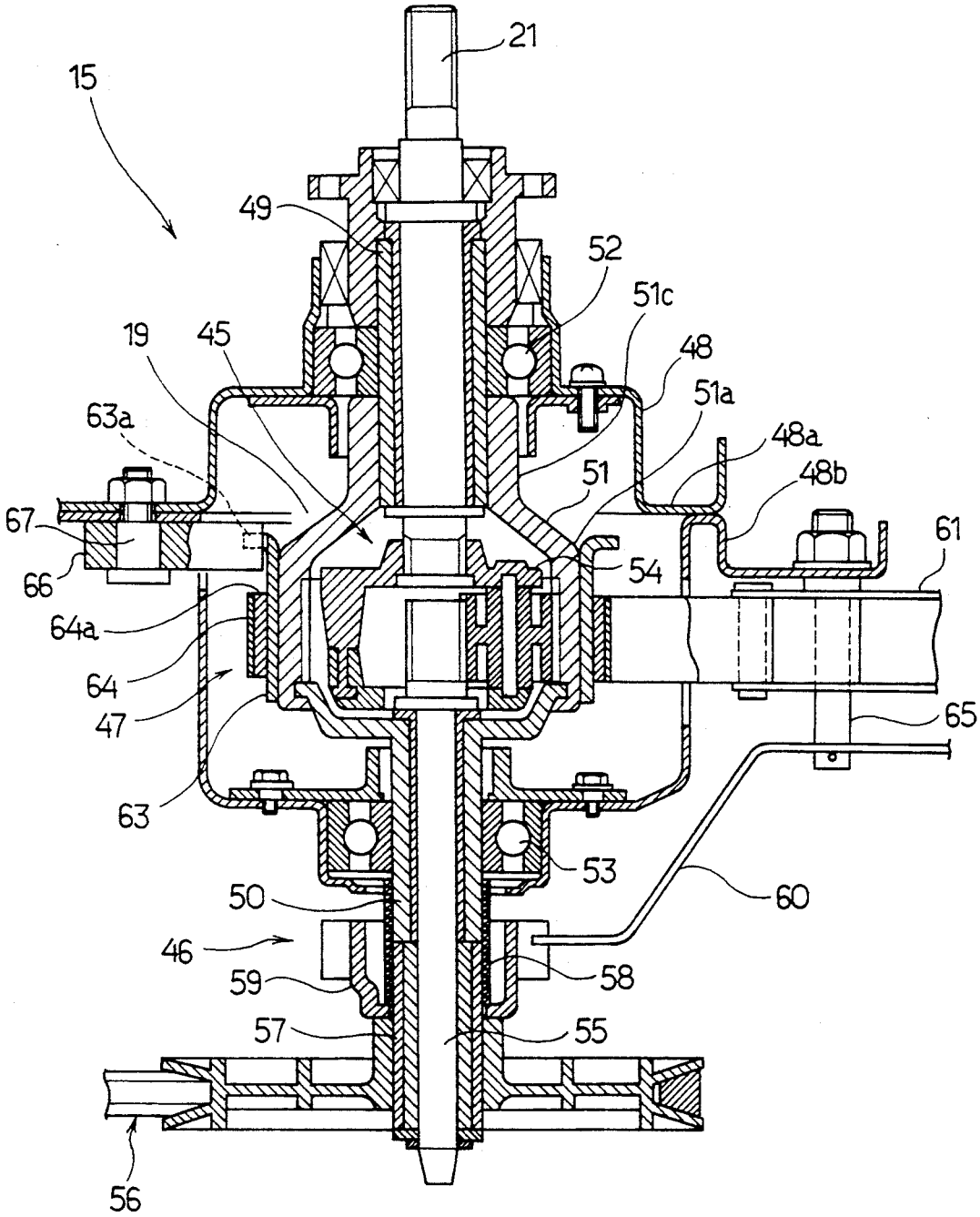
FIG. 5 is a longitudinal section of a drive mechanism of the washing machine.
Figure 6:
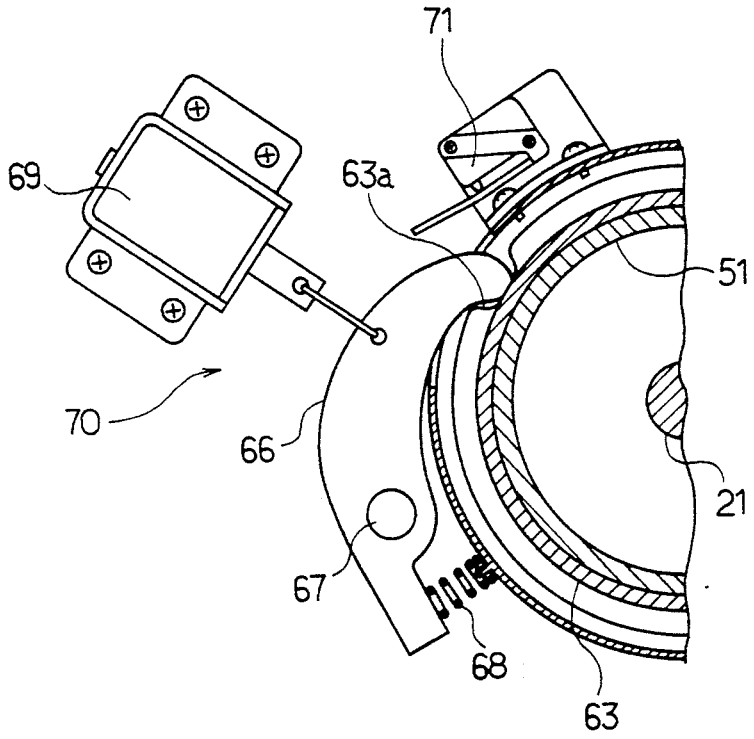
FIG. 6 is a bottom view of locking means with a brake drum transversely sectional.
Figure 7:
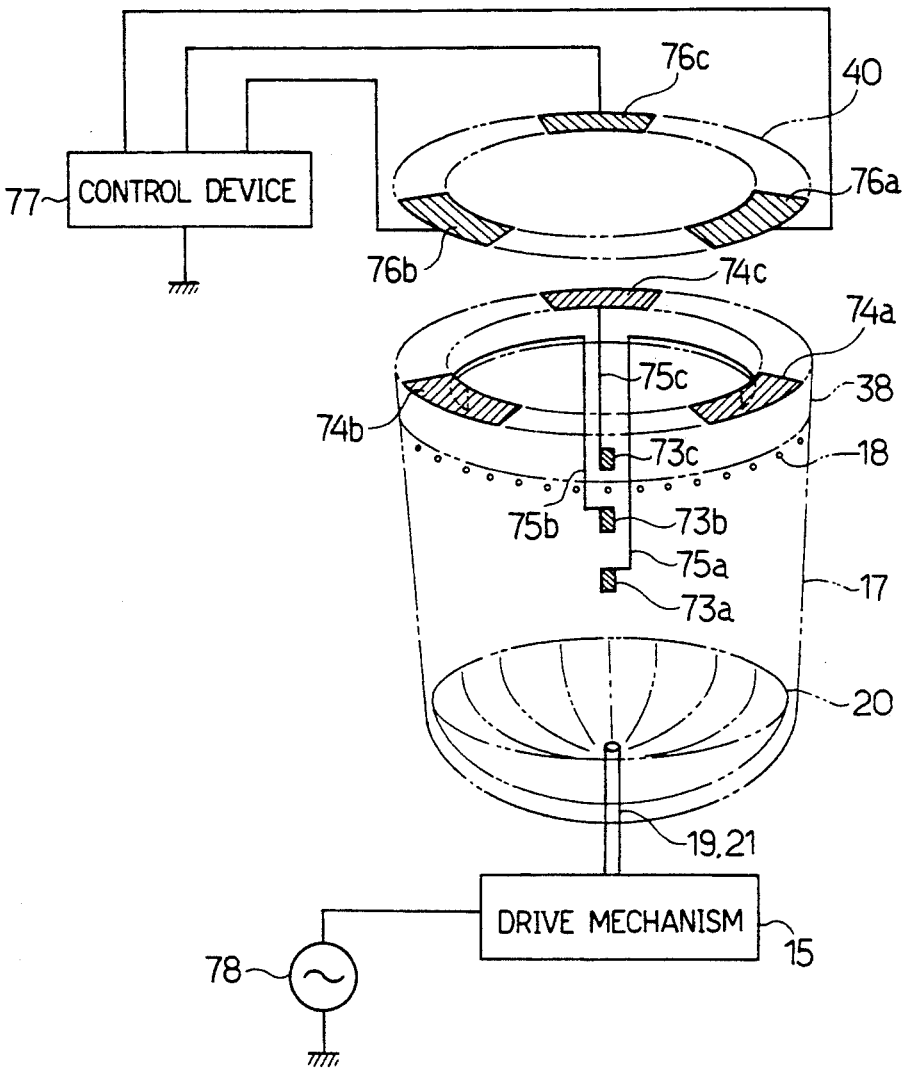
FIG. 7 is a perspective view schematically illustrating electrode plates for performing a water level detection.

The drive mechanism 15 will now be described with reference to FIGS. 5 and 6. Torque of the motor 14 is reduced and transmitted by the drive mechanism 15 to the agitator 20 in the wash step and directly to the inner tub 17 and the agitator 20 in the dehydration step so that they are rotated simultaneously. The drive mechanism 15 comprises a reduction gear unit 45, a clutch mechanism 46 and a brake mechanism 47. A casing 48 of the drive mechanism 15 comprising an upper casing 48*a* and a lower casing 48*b* is secured to the outer bottom of the outer tub 12. The dehydration shaft 19 comprises an upper hollow shaft 49 and a lower hollow shaft 50 integrally coupled with the upper hollow shaft 49 by a gear case 51. The gear case 51 serves as a casing of the reduction gear unit 45 and comprises a gear case body 51*a* and a cover 51*b* covering the underside opening of the gear case body 51*a*, the cover 51*b* being coupled with the gear case body 51*a*. A sleeve 51*c* integrally formed on the upper end of the gear case body 51*a* is coupled to the upper hollow shaft 49 and the lower hollow shaft 50 is integrally formed on the lower portion of the cover 51*b*. The upper hollow shaft 49 of the dehydration shaft 19 is supported on the upper casing 48*a* via a bearing 52 and the lower hollow shaft 50 is supported on the lower casing 48*b* via a bearing 53.

A well-known planetary gear mechanism 54 is provided in the gear case 51 for the purpose of reduction. The above-mentioned wash shaft 21 is an output shaft of the planetary gear mechanism 54. The torque of the motor 14 is transmitted to an input shaft of the planetary gear mechanism 54 or a drive shaft 55 through a belt transmission mechanism 56 and a connecting shaft 57, thereby rotating the drive shaft 55. The clutch mechanism 46 comprises a clutch spring 58, a clutch sleeve 59 forming a lower portion of the clutch spring 58, a clutch lever 60 and the like. Drive of the clutch lever 60 is controlled together with that of a brake lever 61 by an electromagnet 62 (FIG. 8) which will be described later.

The brake mechanism 47 will be described. A brake drum 63 is secured to the outer circumferential surface of the gear case body 51*a*. A brake band 64 applying braking force to the brake drum 63 is applied to the outer circumference of the brake drum 63. One of two ends of the brake band 64 is connected to a pin 65 fixed to the lower case 48*b* and the other end thereof is connected to the brake lever 61 rotatably mounted on the lower case 48*b* by the pin 65. A brake shoe 64*a* is mounted on the face of the brake band 64 contacting the brake drum 63. The brake lever 61 usually urged by a tension spring (not shown) or the like in the direction that the brake band 64 is tightened up against the brake drum 63. Upon energization of the electromagnet 62, the brake lever 61 is rotatively driven in the direction that the brake band 64 is untightened.

The brake drum 63 has an upper flange in which an engagement portion such as a cut-out portion 63*a* is formed. A locking lever 66 serving as a locking member is rotatably mounted on the casing 48 by a pin member 67 and is engaged with the cut-out portion 63*a*. The locking lever 66 is usually urged by the compression coil spring 68 in the direction that it is engaged with the cut-out portion 63*a*. Further, the locking lever 66 is rotatively driven by drive means such as an electromagnet 69 so that it is disengaged from the cut-out portion 63*a*. Thus, locking means 70 comprises the locking lever 66, the electromagnet 69, the compression coil spring 68, the cut-out portion 63*a* and the like. A microswitch 71 (FIG. 6) is provided in the vicinity of the locking lever 66. An on-signal as a disengagement signal is generated by the microswitch 71 when the electromagnet 69 is energized or when the locking lever 66 is disengaged from the cut-out portion 63*a*.

Three electrode strips 73*a*, 73*b* and 73*c* are provided on the inside surface of the inner tub 17 so as to have heights different from one another, which heights corresponding to "LOW," "MIDDLE" and "HIGH" respectively. On the inner tub 17 upper end and more particularly, on the balance ring 38 upper face are provided first electrode plates 74*a*, 74*b* and 74*c* the number of which plates corresponds to that of the electrode strips 73*a*–73*c*. These electrode plates 74*a*–74*c* are provided on the balance ring 38 with equal intervals. The first electrode plates 74*a*–74*c* are electrically connected to the electrode strips 73*a*–73*c* by lead wires 75*a*, 75*b* and 75*c*, respectively. Second electrode plates 76*a*, 76*b* and 76*c*, the number of which plates corresponds to that of the first electrode plates 74*a*–74*c*, are provided on a non-rotational member opposed to the balance ring 38 upper face, for example, the underside of the tub cover 40. The second electrode plates 76*a*–76*c* are provided on the tub cover 40 underside with uniform intervals so as to form pairs with the first electrode plates 74*a*–74*c*, respectively. The first electrode plates 74*a*–74*c* are opposed to the second electrode plates 76*a*–76*c* respectively when the inner tub 17 is located at the predetermined position after rotation. The second electrode plates 76*a*–76*c* are connected to a control device 77. An oscillator 78 oscillating a sine wave signal of 10 KHz is connected to the drive mechanism 15, for example.

Figure 8:
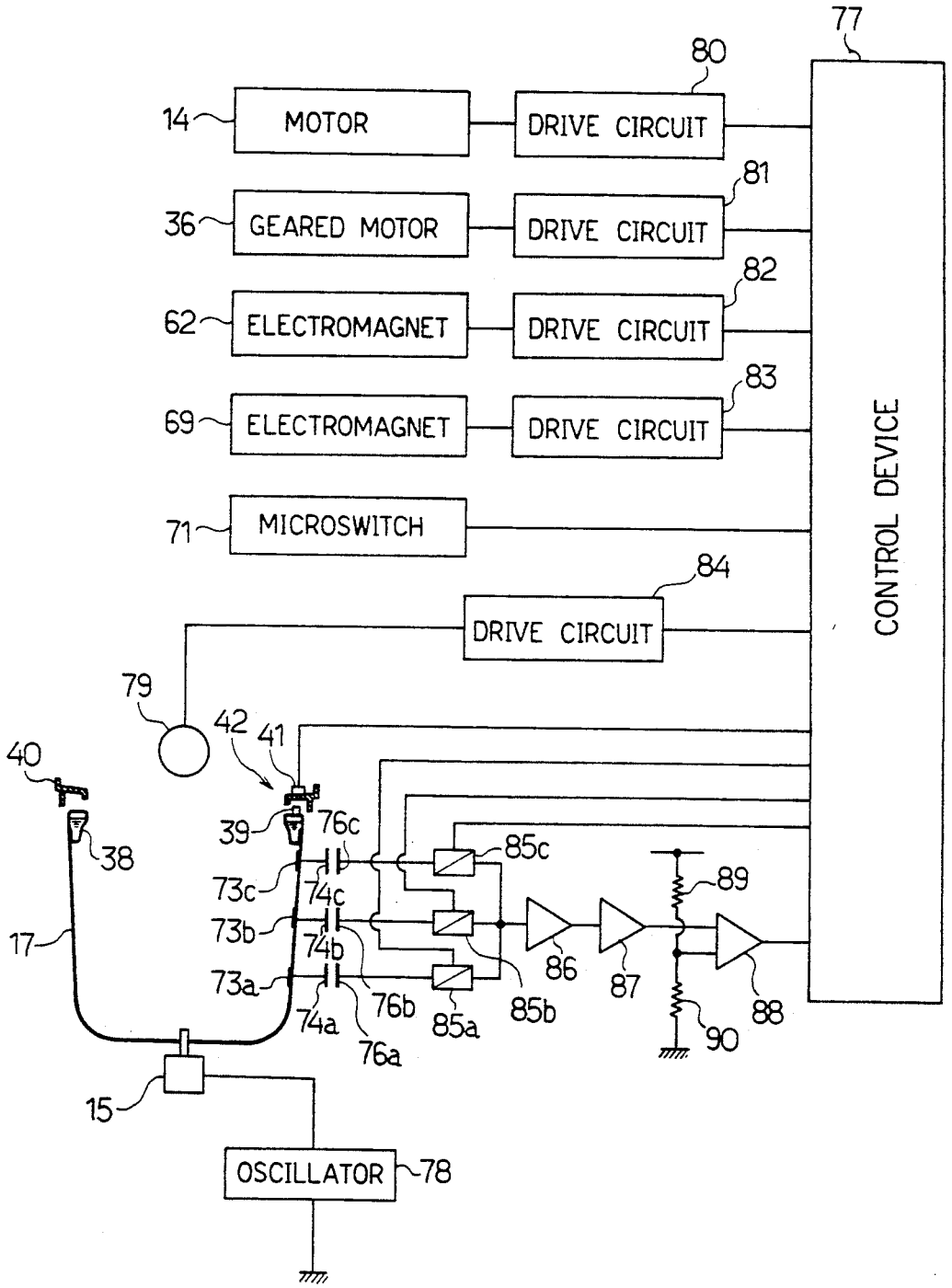
FIG. 8 is a block diagram showing an electrical arrangement of the washing machine.

Referring to FIG. 8 showing an electrical arrangement of the washing machine, the control device 77 comprises a microcomputer, for example. The microcomputer incorporates a control program for controlling an overall washing operation and is arranged to control energization of loads such as the motor 14, the geared motor 36, the electromagnets 62, 69 and a water supply valve for supplying water to the inner tub 17 through drive circuits 80 to 84 and the like. The control device 77 is supplied with a position signal indicative of the position of the inner tub 17 from the reed switch 41 of the position sensor 42 and a switch signal from the microswitch 71. Further, the control device 77 is supplied with a water level signal from the second electrode plates 76*a*–76*c* through a signal reception switching circuit comprising analog switches 85*a*, 85*b* and 85*c*, a filter 86, an amplifier 87 and a comparator 88 sequentially. Reference numerals 89 and 90 designate resistances dividing a dc power supply voltage, respectively.

Figure 9:
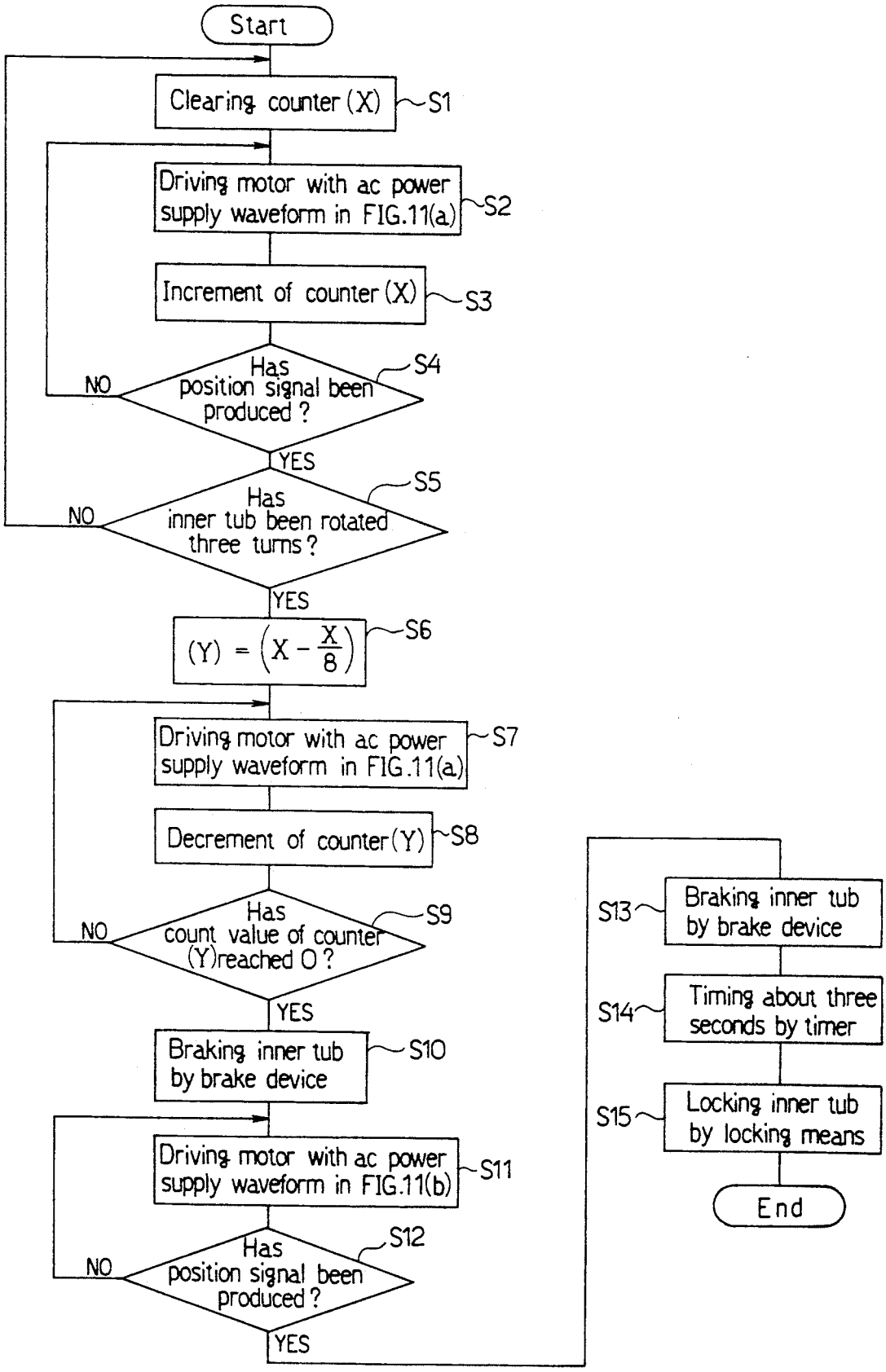
FIG. 9 is a flowchart for explaining stopping the inner tub at a predetermined position.
Figure 10:
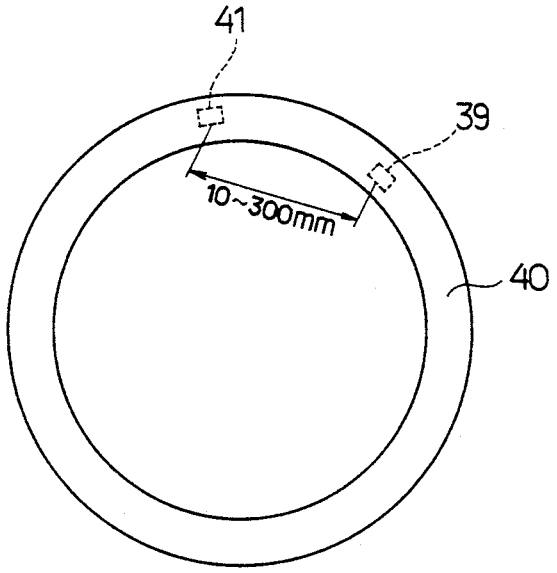
FIG. 10 is a top plan view of the inner tub.
Figure 11A:
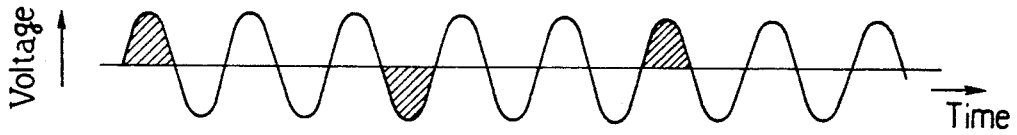
FIGS. 11(*a*) and 11(*b*) are waveform charts when the motor is energized.
Figure 11B:
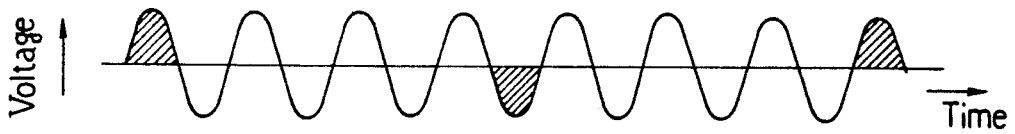

Operation of the washing machine will be described with reference to FIGS. 9–11. First, in supplying water into the inner tub 17, the control device 77 executes control that the inner tub is rotated and then stopped at the predetermined position. Referring to FIG. 9 showing this control, the inner tub 17 is braked off by energizing the electromagnet 62 of the brake device 47 and then, the locking lever 66 is disengaged from the cut-out portion 63*a* of the brake drum 63 by energizing the electromagnet 69. In this condition the motor 14 is controlled by the control device 77 so as to be energized and deenergized at predetermined intervals such that the inner tub 17 is rotated at a speed lower than the rotational speed in the dehydration step. More specifically, the motor 14 is energized, for example, in one half cycle of the ac power supply waveform and deenergized in the next four half cycles, as shown in FIG. 11(*a*) and such energization and deenergization are alternately repeated so that the inner tub 17 is rotated at the speed of 30 r. p. m. This speed is in a high-speed mode. The inner tub 17 is rotated at 30 r. p. m. by three turns or until the position signal is produced from the reed switch 41 of the position sensor 42 three times and the time period necessary for one turn is measured. More specifically, increment of the count value of a counter (X) is performed in the period between output of the second position signal and output of the third position signal (steps S1 through S5). Subsequently, the motor 14 and the electromagnet 62 are deenergized when the inner tub 17 is rotated at 30 r. p. m. by seven eighths of one turn from the predetermined position, thereby braking the inner tub 17 by the brake device 47. More specifically, the value corresponding to seven eighths of the count value of the counter (X) is substituted in a counter (Y) and decrement of the substituted value in the counter (Y) is performed. The brake device 47 is activated to brake the inner tub 17 when the count value reaches zero (steps S6–S10). Consequently, the inner tub 17 is stopped at such a position that the magnet 39 takes a position 10 to 300 mm before the reed switch 41, as shown in FIG. 10. Thereafter, the inner tub is rotated at a speed lower than previous speed. As shown in FIG. 11(*b*), the motor 14 is energized, for example, in one half cycle of the ac power supply waveform and deenergized in the next six half cycles and such energization and deenergization are alternately repeated so that the inner tub 17 is rotated at the speed of about 1 r. p. m. (step S11). This speed is such a very slow speed that the inner tub 17 is stopped immediately when braked by the brake device 47, and in a slow speed mode. The position signal is produced from the reed switch 41 when the inner tub 17 rotating at the very slow speed reaches the predetermined position. Upon receipt of the position signal, the control device 77 operates to deenergize the motor 14 and to activate the brake device 47 so that the inner tub 17 is braked to be stopped (steps S12 and S13). Consequently, the inner tub 17 is stopped in the condition that the magnet 39 is opposite to the reed switch 41, that is, the first electrode plates 74*a*–74*c* are opposite to the second electrode plates 76*a*–76*c* respectively. Subsequently, after a lapse of three seconds, for example, the control device 77 operates to deenergize the electromagnet 69 so that the locking lever 66 engages the cut-out portion 63*a* of the brake drum 63, thereby locking the inner tub 17 (steps S14 and S15).

The water supply valve 79 is energized to be opened in the above-described condition, thereby initiating water supply into the inner tub 17. Since the drain hole 23 is closed by the valve mechanism 24 at this time, water is reserved only in the inner tub 17. The water level in the inner tub 17 is gradually raised, reaching the lowermost electrode strip 73*a*. When the water surface contacts the electrode strip 73*a*, it is electrically connected to the oscillator 78. Consequently, the output signal from the oscillator 78 is transferred to the electrode strip 73*a* and further to the first electrode plate 74*a* electrically connected to the electrode strip 73*a*. The oscillator output signal is then transferred from the first electrode plate 74*a* to the second electrode plate 76*a* capacitive coupled to the electrode plate 74*a*. When the analog switch 85*a* of the signal reception switching circuit is effected so that the water level in the inner tub 17 is stopped at a "LOW" position where the electrode strip 73*a* is located, the signal transferred to the second electrode plate 76*a* is transferred through the analog switch 85*a* to a filter 86 eliminating noise from the signal and then to the amplifier 87 amplifying the signal. The amplified signal having the voltage value of the larger than the value of voltage divided by the resistances 89, 90 is supplied as the water level signal to the control device 77 through the comparator 80. Consequently, it is determined that the water level in the inner tub 17 has reached the electrode strip 73*a* of the "LOW" position.

On the other hand, when the analog switch 85*b* of the signal reception switching circuit is effected so that the water level in the inner tub 17 is stopped at a "MIDDLE" position where the electrode strip 73*b* is located, the water level signal is supplied to the control device 77 through the first electrode plate 74*b*, the second electrode plate 76*b*, the analog switch 85*b* and so on in the same manner as described above when the water level in the inner tub 17 reaches the electrode strip 73*b* and the water surface contacts the same. Consequently, it is determined that the water level in the inner tub 17 has reached the "MIDDLE" position.

Furthermore, when the analog switch 85*c* of the signal reception switching circuit is effected so that the water level in the inner tub 17 is stopped at a "HIGH" position where the electrode strip 73*c* is located, the water level signal is supplied to the control device 77 through the first electrode plate 74*c*, the second electrode plate 76*c*, the analog switch 85*c* and so on in the same manner as described above when the water level in the inner tub 17 reaches the electrode strip 73*c* and the water surface contacts the same. Consequently, it is determined that the water level in the inner tub 17 has reached the "HIGH" position.

The water supply valve 79 is deenergized to be closed when the necessary water level is reached in each of the above-described cases, and instead, the motor 14 is energized to drive the agitator, thereby initiating the wash step.

Water draining from the inner tub 17 will now be described. The inner tub 17 is stopped at the predetermined position and locked there by the locking means 70 after the wash step is completed. The drain hole 23 of the inner tub 17 and the valve mechanism are opposite to the drive section 29 in this condition, as shown in FIG. 1. The geared motor 36 of the drive section 29 is energized to rotate the cam 37 to a position indicated by an alternate long and two short dashes line in FIG. 1, thereby moving the push rod 32 upward. The push rod 32 strikes against the lower end of the support bar 25*a* of the valve 25 to push it upward such that the drain hole 23 is opened. Consequently, the wash liquid is discharged through the drain hole 23 into the outer tub 12. The wash liquid is further discharged outwards from the outer tub 12 through the drain hose 16.

In the case where the dehydration operation is executed, the geared motor 36 is deenergized or energized so as to be reverse rotated so that the cam 37 is reverse rotated to the position shown by the solid line in FIG. 1. As a result, the push rod 32 is moved downward and the valve 25 is urged by the compression coil spring 26 so as to move downward, which closes the drain hole 23. Simultaneously, the electromagnet 62 is energized so that the inner tub 17 is braked off, and the electromagnet 69 is energized so that the locking lever 66 is disengaged from the cut-out portion 63*a* of the brake drum 63. In this condition, the motor 14 is energized to rotate the inner tub 17 at the high speed. The clothes containing the wash liquid in the inner tub 17 are centrifugally dehydrated and the wash liquid resulting from the centrifugal dehydration is discharged through the perforations 18 formed in the upper end portion of the inner tub 17.

The inner tub 17 is rotated and then stopped at the predetermined position in the same manner as described above when water is supplied to the inner tub 17 for execution of a rinse operation. Then, the water supply is performed.

In the wash and rinse steps, the water subjected to a pumping action of outvanes 20*a* due to rotation of the agitator 20 is sucked through apertures (not shown) formed in the cover member 43 into the space between the cover member 43 and the inner tub 17 and then flows toward the outvanes 20*a*. On the other hand, part of the water subjected to the pumping action of the outvanes 20*a* is caused to flow through the space between the cover member 44 and the inner tub 17 to a lint filter 44*a* attached to the upper end of the cover member 44.

Figure 19:
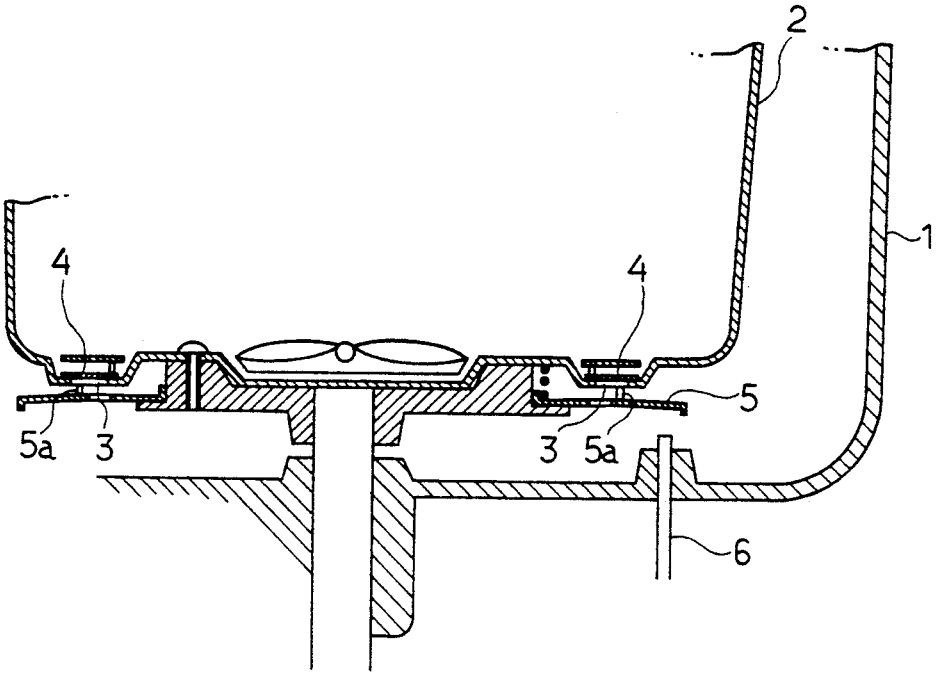
FIG.19 (PRIOR ART)
FIG. 19 is a longitudinal section of the bottom of an inner tub of a conventional washing machine.
Figure 20:
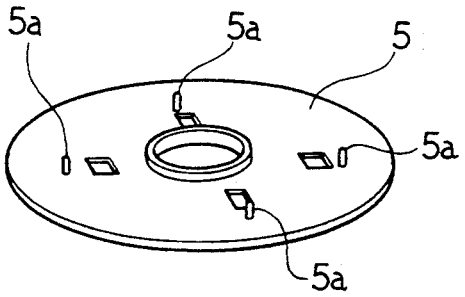
FIG.20 (PRIOR ART)
FIG. 20 is a perspective view of an operating disc employed in the conventional washing machine.

In accordance with the above-described embodiment, the dehydration perforations 18 are formed only in the upper end portion of the inner tub 17. Accordingly, the water is reserved only in the inner tub 17 in the washing operation. Since the wash liquid is not reserved between the inner and outer tubs 12, 17, the soap powder scum or the like is prevented from adhering to the inner surface of the outer tub 12 and the outer surface of the inner tub 17. If the soap powder scum should adhere to the outer tub inner surface and the inner tub outer surface, reverse flow of the scum into the inner tub with water is prevented. Consequently, the clothes to be washed can be prevented from being dirtied by the scum. Further, in the water discharge, the valve 25 of the valve mechanism 24 is driven to open the drain hole 23 by upwardly moving the push rod 32 of the drive section 29, whereby the wash liquid in the inner tub 17 is discharged through the drain hole 23 formed in the inner tub bottom. Consequently, a large amount of water can be prevented from colliding with the outer tub 12, which prevents occurrence in a loud noise. Further, since the foreign matter such as sand or dust is also discharged through the drain hole 23 together with the wash liquid, the foreign matter can be prevented from being accumulated on the inner tub bottom. Further, since the push rod 32 of the drive section 29 is upwardly moved to drive the valve 25 of the valve mechanism 24 in the condition that the inner tub 17 is stopped at the predetermined position, the drain hole opening and closing operations of the valve mechanism 24 can be exactly performed. Consequently, since the amount of opening of the drain hole 23 is always fixed when the water is discharged from the inner tub 17, the water discharge performance can be stabilized as compared with the conventional construction shown in FIGS. 19 and 20 and the time period necessary for the water discharge can be prevented from being lengthened or shortened.

Since the position sensor 42 is provided to produce the position signal when the predetermined position is reached by the inner tub 17 being rotated, the inner tub 17 can be stopped at the predetermined position with ease. In the foregoing embodiment, particularly, the inner tub 17 is rotated at the low speed in order that the inner tub 17 is stopped at the predetermined position and consequently, the inner tub 17 can be stopped exactly at the predetermined position. Further, when the inner tub 17 is rotated at the low speed, it is rotated at the relatively higher low speed (high-speed mode) until reaching the position in the vicinity of and not beyond the predetermined position or 10 to 300 mm behind the predetermined position and stopped once. Thereafter, the inner tub 17 is rotated at the very slow speed (low-speed mode) and then, stopped at the predetermined position. Thus, the distance that the inner tub 17 is rotated at the very slow speed can be reduced, which shortens the period of rotation of the inner tub 17 at the very slow speed. Consequently, the time period necessary for stopping the inner tub 17 at the predetermined position can be reduced. Furthermore, since the position sensor 42 comprises the magnet 39 mounted on the balance ring 38 of the inner tub 17 and the reed switch 41 mounted on the tub cover 40 of the outer tub 12, these parts can be assembled sequentially from the top, which simplifies the assembly steps. The sensing section including the reed switch is provided at the fixed side since the sensing section necessitates lead wires. The sensed section including the magnet 39 is provided at the rotational side since the sensed section necessitates no lead wires. Consequently, the wiring can be simplified.

The locking means 70 is provided for locking the inner tub 17 at the predetermined position when the inner tub 17 is stopped at that position. The valve mechanism 24 is driven to open and close the drain hole 23 in the condition that the inner tub 17 is locked at the predetermined position by the locking means 70. Accordingly, the inner tub 17 is not moved while the valve mechanism 24 is being operated, which prevents the valve mechanism 24 from breakage. In the foregoing embodiment, particularly, the inner tub 17 is locked by the locking means 70 after completion of the water supply to the same. Consequently, the inner tub 17 can be prevented from being rotated by the influence of water flows caused by the agitator in the wash and rinse steps. Further, since the valve 25 is provided so that the drain hole 23 is opened and closed from inside of the inner tub 17, the water pressure acts on the valve 25 in the direction that the valve 25 is closed, when the water is reserved in the inner tub 17, which improves the water tightness. Since the inner tub 17 has the dehydration perforations only in the upper end thereof, the water is not reserved in the outer tub 12, which saves an amount of water used in the washing. Additionally, the electrode strips 73*a*–73*c* are provided on the inner surface of the inner tub 17 so as to have respective different heights. Accordingly, the water level can be sensed at a plurality of stages in accordance with the electrode strip positions. The washing can be performed with the suitable water level selected in accordance with the quantity of clothes to be washed. Since the water level is sensed in the condition that the inner tub 17 is stopped at the predetermined position and the first electrode plates 74*a*–74*c* are opposite to the second electrode plates 76*a*–76*c* respectively, each electrode plate need not be provided along the inner circumference of the inner tub 17. Consequently, the size of each electrode plate can be reduced. The wiring becomes complicate when each electrode plate is provided along the inner circumference of the inner tub 17. However, such a complicate wiring is not needed and the wiring can be made reasonably.

Although the water level is sensed in three stages in the foregoing embodiment, more or less stages may be provided. Although the dehydration perforations are formed in the upper end portion of the inner tub 17, a gap between the inner tub top and the balance ring may be utilized as one dehydration outlet, instead. Although the outer tub 12 is provided separately from the outer cabinet 11 in the foregoing embodiment, the outer cabinet 11 may be utilized as the outer tub 12. In this case a partition plate is mounted so as to partition the outer cabinet interior into upper and lower compartments. The upper compartment is used as the outer or water-receiving tub and the drive mechanism such as the motor is provided in the lower compartment. Further, although the water level in the inner tub 17 is sensed by the electrode strips 73*a*–73*c* in the foregoing embodiment, an ultrasonic wave generator may be provided over the inner tub and an ultrasonic wave receiver may be provided so as to receive ultrasonic waves reflected on the water surface. In this case the control that the inner tub 17 is stopped at the predetermined position in the water supply is not necessary. This control may be performed before drive of the valve mechanism at the time of the water discharge.

Although, in the foregoing embodiment, the inner tub 17 is rotated in two stages of rotational speed, that is, at the slow speed and the very slow speed in order that the inner tub 17 is stopped at the predetermined position, it may be rotated in more than two stages of speed. More specifically, a plurality of rotational speed stages may be set in the high-speed mode or in the low-speed mode. Further, although the sensed section of the position sensor 42 comprises the magnet 39 and the sensing section thereof comprises the reed switch 41, the sensed section may comprise a reflecting plate and the sensing section may comprise photo-sensor including a light emitting element and a photoreceptor element.

Figure 12:
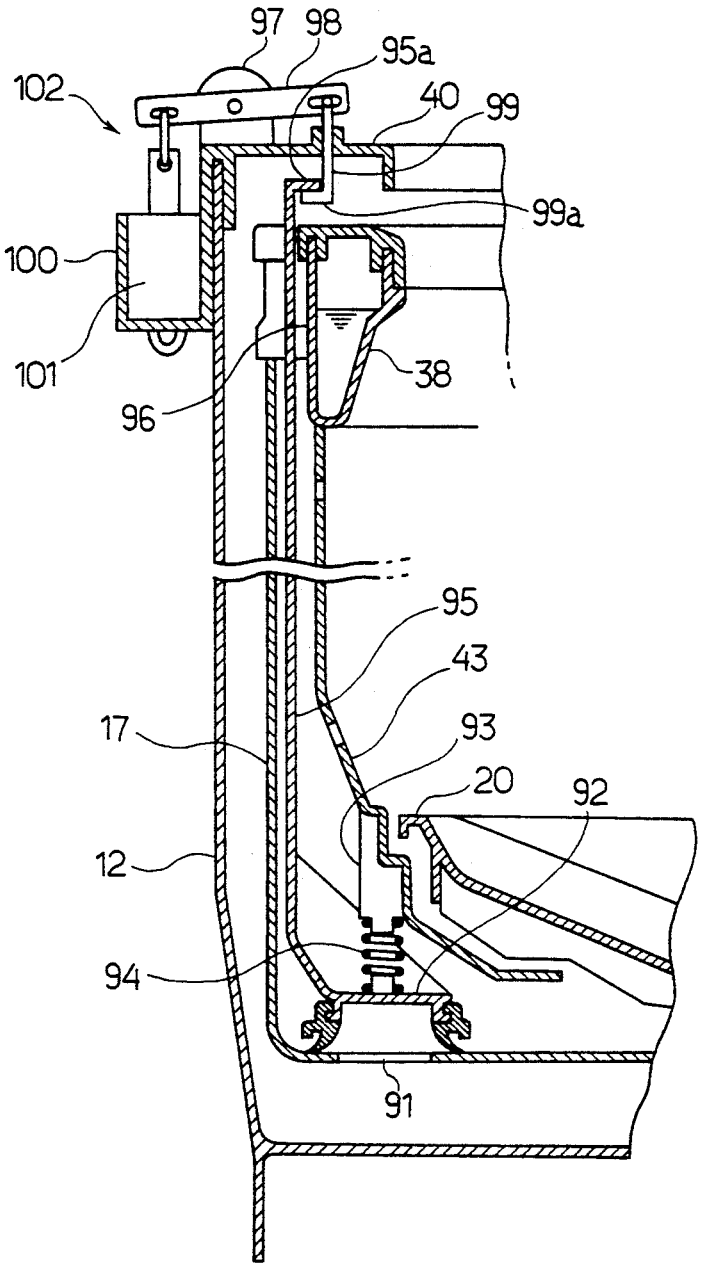
FIG. 12 is a view similar to FIG. 1 showing a second embodiment of the invention.
Figure 13:
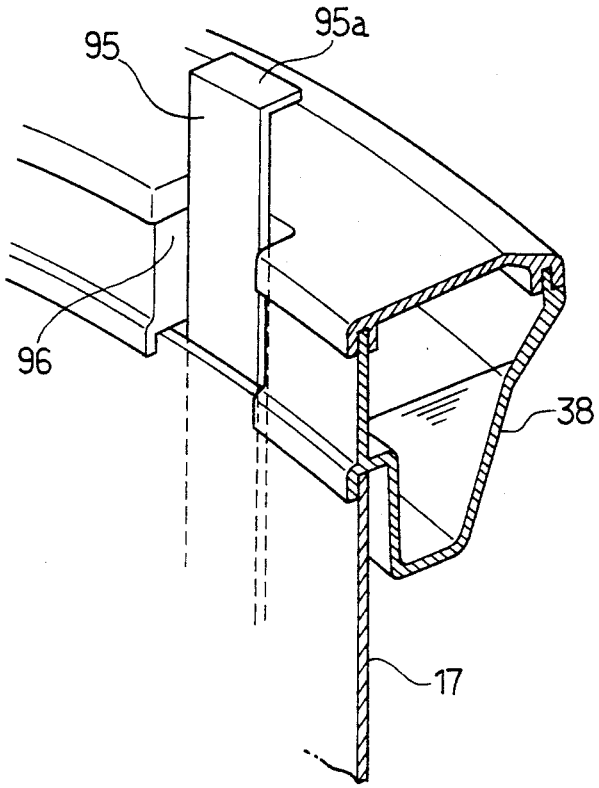
FIG. 13 is a partially broken perspective view of the inner tub.
Figure 14:
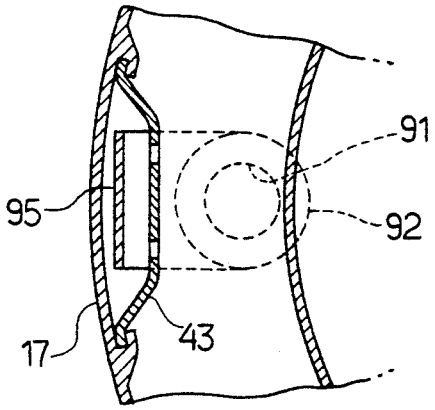
FIG. 14 is a partly transverse section of the inner tub.

FIGS. 12 through 14 illustrate a second embodiment of the invention. Difference between the first and second embodiments will be described. Referring to FIG. 12, a drain hole 91 is provided on the bottom of the inner tub 17, instead of the drain hole 23. A valve 92 opening and closing the drain hole 91 from inside of the inner tub 17 is coupled to a support 93 downwardly projected from the lower underside of the cover member 43 with a compression coil spring provided around the support 93. The valve 92 is usually urged by the compression coil spring 94 so as to close the drain hole 23. A lifting member 95 is formed integrally with the valve 92 so as to be extended from the left-hand end of the valve 92 to the upper end of the inner tub 17, as viewed in FIG. 12. The lifting member 95 is disposed in the space between the cover member 43 and the inner tub 17 and projected over the balance ring 38 through a concave portion 96 formed therein as shown in FIGS. 12–14. The lifting member 95 has at the upper end an engagement portion 95*a* bent at right angles. Thus, the valve mechanism comprises the lifting member 95, the valve 92, the compression coil spring 94, the support 93 and the like. A support convex portion 97 is provided on the upper face of the tub cover 40. A lever 98 is pivotally mounted on the support convex portion 97. An upper end of a lifting bar 99 having at the lower end an engagement portion 99*a* bent at right angles is coupled to the right-hand end of the lever 98. The lifting bar 99 is extended through a hole formed in the tub cover 40 so as to face the upper side of the inner tub 17. The engagement portion 99*a* of the lifting bar 99 is opposite to the engagement portion 95*a* of the lifting member 95 in the condition that the inner tub 17 is stopped at the predetermined position, as shown in FIG. 12. An electromagnet 101 is enclosed in a container 100 provided on the circumferential portion of the tub cover 40. The lever 98 is rotatively moved by the electromagnet 101. Thus, a drive section 102 comprises the electromagnet 101, the lever 98 and the lifting bar 99 and is disposed on the top of the outer tub 12.

Upon energization of the electromagnet 101 of the drive section 102, the lever 98 is rotatively moved in a counterclockwise direction as viewed in FIG. 12, which motion raises the lifting bar 99 upward such that the engagement portion 99*a* of the lifting bar 99 is engaged with the engagement portion 95*a* of the lifting member 95, thereby lifting the lifting member 95. Consequently, the valve 92 is upwardly moved to open the drain hole 91. In the usual condition that the electromagnet 101 is deenergized, the lever 98 is returned to the position shown in FIG. 12 and accordingly, the lifting bar 99 is lowered to the position shown in FIG. 12. Further, the engagement portion 95*a* of the lifting member 95 is disengaged from the engagement portion 99*a* of the lifting bar 99 and the valve 92 closes the drain hole 91.

The same effect can be achieved in the second embodiment as in the previous embodiment. In particular, since the drive section 102 is disposed on the top of the outer tub 12, the waterproof construction including the bellows 33 and the like is unnecessary. Consequently, leakage of the water from the outer tub 12 can be prevented.

Figure 15:
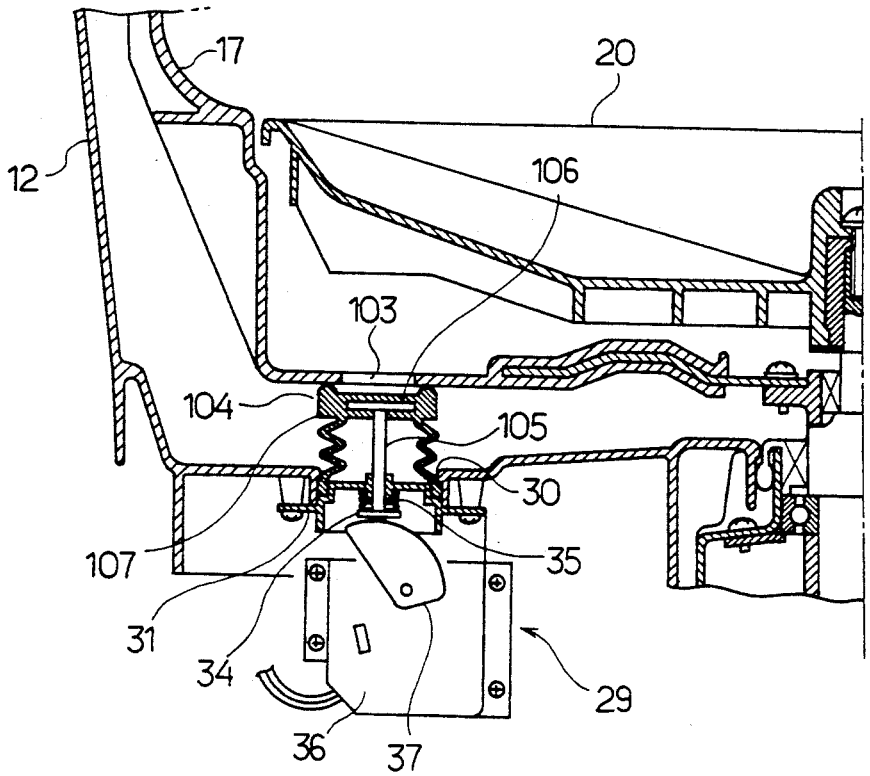
FIG. 15 is a view similar to FIG. 1 showing a third embodiment of the invention in the condition that a drain hole is closed.
Figure 16:
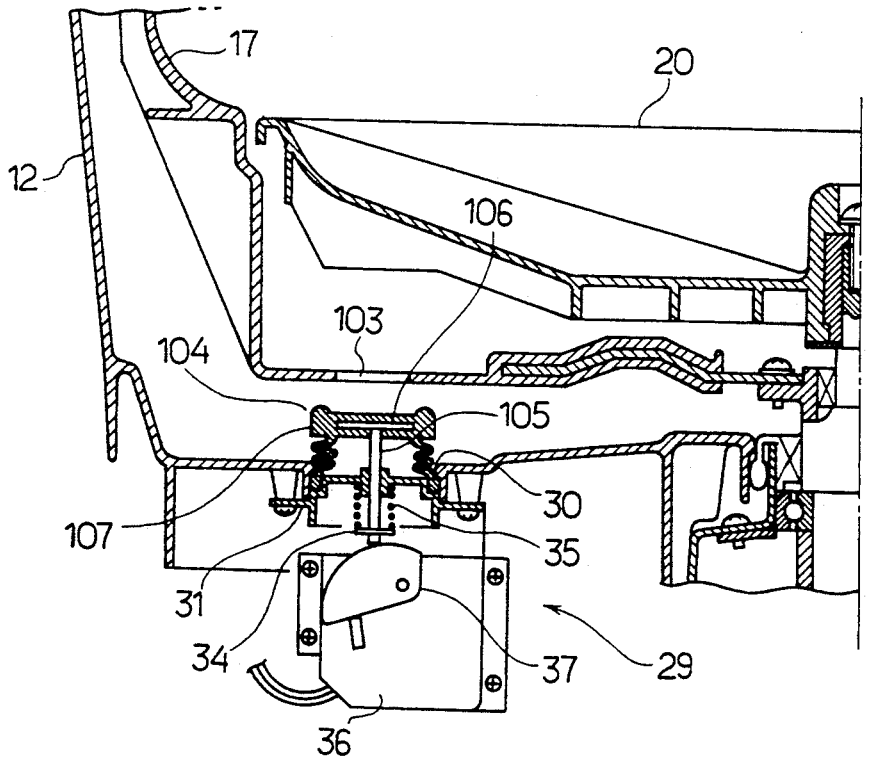
FIG. 16 is a view similar to FIG. 1 showing the third embodiment in the condition that the drain hole is opened.

FIGS. 15 and 16 illustrate a third embodiment of the invention. Referring to FIG. 15, a drain hole 103 is formed in the bottom of the inner tub 17, instead of the drain hole 23. A valve 104 opening and closing the drain hole 103 from the outer bottom side of the inner tub 17 is formed integrally with a push rod 105 of the drive section 29. A plate member 106 having approximately the same dimensions as the drain hole 103 is secured to the upper end of the push rod 105. A bellows 107 is formed integrally with the plate member 106 to cover the plate member 106 and the upper end portion of the push rod 105. The bellows 107 is fixed at the peripheral edge thereof to the outer bottom of the outer tub 12 by the mounting plate 31 so as to close the throughhole 30 of the outer tub 12. The valve mechanism thus comprises the valve 104, the push rod 105, the plate member 106, the bellows 107 and the like. Consequently, the valve 104 is provided so as to be vertically movable. The drain hole 103 of the inner tub 17 is closed when the valve 104 is upwardly moved, as shown in FIG. 15 and it is opened when the valve 104 is downwardly moved, as shown in FIG. 16.

The same effect can be achieved in the third embodiment as in the first embodiment. In particular, since the valve or the like is not provided in the inner tub 17 though the drain hole 103 is formed therein, the construction of the inner tub 17 can be simplified and the weight thereof can be reduced. The weight reduction of the inner tub is advantageous since the inner tub 17 is rotated at a high speed at the time of the dehydration.

Figure 17:
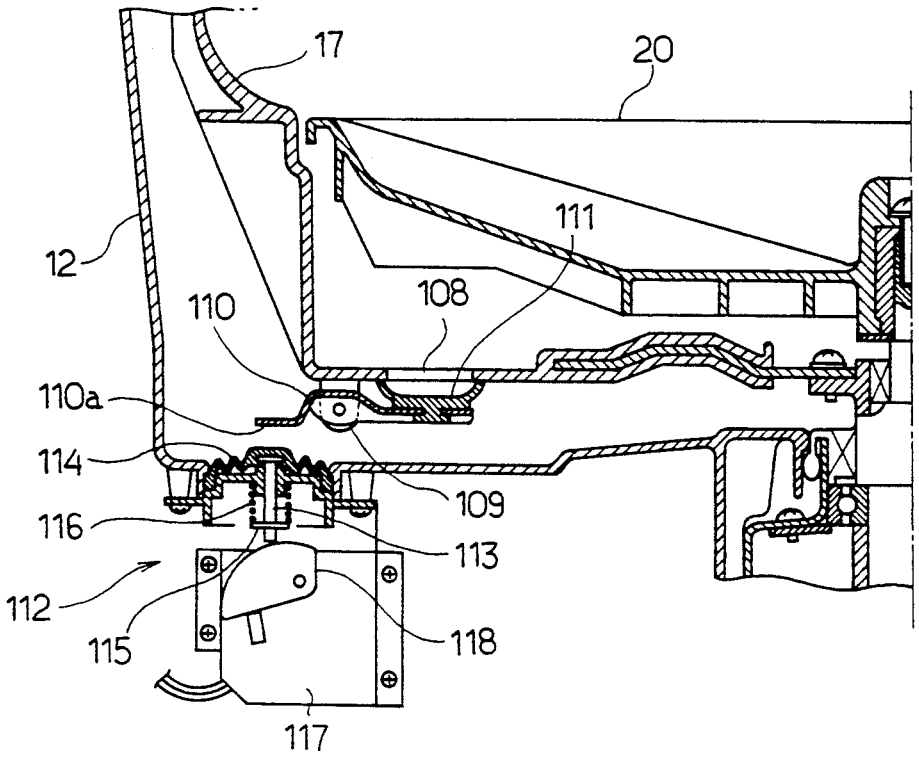
FIG. 17 is a view similar to FIG. 15 showing a fourth embodiment of the invention.
Figure 18:
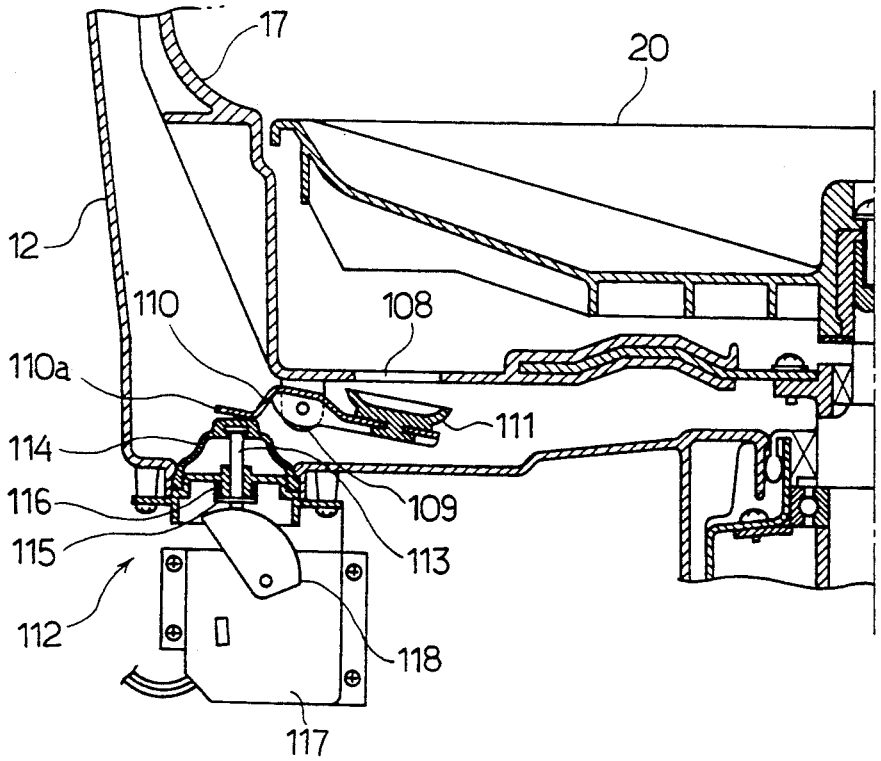
FIG. 18 is a view similar to FIG. 16 showing the fourth embodiment.

FIGS. 17 and 18 illustrate a fourth embodiment of the invention. In FIG. 17, a drain hole 108 is formed in the bottom of the inner tub 17, instead of the drain hole 23. A support convex portion 109 is provided in the vicinity of the drain hole 108 on the outer bottom of the inner tub 17. A lever member 110 is pivotally mounted on a shaft mounted on the support convex portion 109. A valve 111 opening and closing the drain hole 108 from the outer bottom side of the inner tub 17 is mounted on a right-hand end of the lever member 110. The other end of the lever member 110 is formed into a flat push portion 110*a*. The lever member 110 is usually urged by a spring (not shown) in the direction that the valve 111 closes the drain hole 108. The valve mechanism comprises the lever member 110, the valve 111, the support convex portion 109 and the like. A drive section 112 is provided on the outer bottom of the outer tub 12 so as to correspond to the push portion 110*a* of the lever member 110. The drive section 112 has nearly the same construction as that of the drive section 29 in the first embodiment and comprises the push rod 113, the bellows 114, the spring shoe 115, the compression coil spring 116, the geared motor 117, the cam 118 and the like.

Upon energization of the geared motor 117 of the drive section 112, the cam 118 is rotated so as to take a position shown in FIG. 18, whereby the push rod 113 is moved upward. The push rod 113 then pushes the push portion 110*a* of the lever member 110 to raise the same, which motion rotatively moves the lever member 110 in a clockwise direction. Consequently, the valve 11 is moved downward and the drain hole 108 is opened.

The same effect can be achieved in the fourth embodiment as in the first embodiment. In particular, the valve 111 opening and closing the drain hole 108 is provided at the outside of the inner tub 17. The valve 111 is opened and closed by rotatively moving the lever member 110. Accordingly, the movement stroke of the valve 111 and an amount of opening of the drain hole 108 can be set with ease by adjusting a rotative movement angle and length of the lever member 110. Consequently, the draining performance can be further improved.

The foregoing disclosure and drawings are merely illustrative of the principles of the present invention and are not to be interpreted in a limiting sense. The only limitation is to be determined from the scope of the appended claims.

We claim:

1. A washing machine comprising:

(a) an outer tub (b) an inner tub rotatably mounted in the outer tub, the inner tub having one or a plurality of dehydration outlets formed in an upper end portion thereof;

(c) a single drain hole formed in the bottom of the inner tub;

(d) a valve mechanism provided for opening and closing the drain hole;

(e) a drive section provided in the outer tub for driving the valve mechanism so that the drain hole is opened and closed; and (f) stop means for stopping the inner tub at a predetermined position where the drain hole corresponds to the drive section, the drain hole being capable of being opened and closed by the drive section and the valve mechanism when the inner tub is stopped at the predetermined position.

2. A washing machine according to claim 1, wherein the stop means comprises a position sensor generating a position signal when the inner tub is located at the predetermined position, the stop means stopping the inner tub at the predetermined position based on the position signal generated by the position sensor.

3. A washing machine according to claim 2, wherein the stop means comprises first means for braking the inner tub being rotated in a high-speed mode based on the position signal generated by the position sensor, thereby stopping the inner tub at a position in the vicinity of and not beyond the predetermined position, and second means for rotating the inner tub in a low-speed mode after the same is stopped by the first means and then braking the inner tub being rotated in the low-speed mode so that the same is stopped at the predetermined position.

4. A washing machine according to claim 2, wherein the stop means comprises first means for braking the inner tub based on the position signal generated by the position sensor in the condition that the inner tub is being rotated at a speed lower than a speed at which the inner tub is rotated in a dehydrating operation, thereby stopping the inner tub at a position in the vicinity of and not beyond the predetermined position after the inner tub is rotated seven-eighths of one rotation from the predetermined position, and second means for rotating the inner tub at such a low speed that the inner tub is stopped immediately when braked, after the same is stopped by the first means and then stopping the inner tub at the predetermined position based on the position signal generated by the position sensor.

5. A washing machine according to claim 2, which further comprises a balance ring provided on the upper portion of the inner tub and a cover covering an upper open end of the outer tub and the position sensor comprises a sensed section provided on the balance ring and a sensing section provided on the cover.

6. A washing machine according to claim 1, which further comprises an agitator rotatably mounted on the inner bottom of the inner tub, the drain hole being positioned below the agitator.

7. A washing machine according to claim 1, which further comprises locking means for locking the inner tub at the predetermined position in the condition that the inner tub is stopped at the predetermined position, the drain hole being opened and closed in the condition that the inner tub is locked at the predetermined position by the locking means.

8. A washing machine according to claim 7, wherein the inner tub has a tub shaft and the locking means comprises an engagement portion formed in the tub shaft, a locking member provided on an outer fixed portion of the tub shaft for engaging the engagement portion and drive means for driving the locking member.

9. A washing machine according to claim 8, wherein the tub shaft has a brake drum for braking the inner tub and the engagement portion is formed in the brake drum.

10. A washing machine according to claim 1, wherein the valve mechanism comprises a valve opening and closing the drain hole from inside of the inner tub and the drive section comprises a push member vertically moved to push the valve so that the drain hole is opened.

11. A washing machine according to claim 10, wherein the valve mechanism comprises a valve having a packing and an urging member urging the valve in the direction that the drain hole is closed by the valve and the drive section comprises a push member mounted on the outer tub so as to be vertically moved, a bellows provided on the outer tub so as to cover the push member and a motor driving the push member via a cam.

12. A washing machine according to claim 1, wherein the valve mechanism comprises a valve opening and closing the drain hole from inside of the inner tub and a lifting member provided on the valve so as to be extended to the upper end of the inner tub, the drive section lifting the lifting member to thereby open the drain hole.

13. A washing machine according to claim 1, wherein the valve mechanism comprises a valve provided on the bottom of the outer tub so as to be vertically moved and the drain hole is closed when the valve is upwardly moved and opened when the valve is downwardly moved.

14. A washing machine according to claim 1, wherein the valve mechanism comprises a lever member pivotally mounted on the outer bottom of the inner tub, the lever member having two ends and a valve provided on one end of the lever member for opening and closing the drain hole from outside of the inner tub and the drive section includes a push member vertically moved so that the same upwardly pushes the other end of the lever member to downwardly move the valve, thereby opening the drain hole.

15. A washing machine comprising:

(a) an outer tub;

(b) an inner tub rotatably mounted in the outer tub, the inner tub having one or a plurality of dehydration outlets formed in an upper end portion thereof;

(c) one or a plurality of drain holes formed in the bottom of the inner tub;

(d) a valve mechanism provided for opening and closing the drain holes;

(e) stop means for stopping the inner tub at a predetermined position, said stop means comprising a position sensor generating a position signal when the inner tub is located at the predetermined position, the stop means stopping the inner tub at the predetermined position based on the position signal generated by the position sensor; and (f) a drive section provided in the outer tub for driving the valve mechanism so that the drain holes are opened and closed, in the condition that the inner tub is stopped at the predetermined position.

* * * * *